US007334280B1

(12) United States Patent
Swartzburg

(10) Patent No.: US 7,334,280 B1
(45) Date of Patent: Feb. 26, 2008

(54) VENTILATED MATTRESS AND METHOD

(76) Inventor: Rick T. Swartzburg, 32834 Barrett Dr., Westlake Village, CA (US) 91361

( * ) Notice: Subject to any disclaimer, the term of this patent is extended or adjusted under 35 U.S.C. 154(b) by 0 days.

(21) Appl. No.: 11/503,435

(22) Filed: Aug. 11, 2006

(51) Int. Cl.
*A47C 27/15* (2006.01)

(52) U.S. Cl. ..... 5/724; 5/652.1; 5/740; 5/727

(58) Field of Classification Search ..... 5/691, 5/724, 726, 730, 740, 652.1, 901, 652.2
See application file for complete search history.

(56) References Cited

U.S. PATENT DOCUMENTS 5,327,597 A 7/1994 Rothbard
5,974,609 A 11/1999 Nunez et al.
6,199,234 B1 3/2001 Srour et al.
6,484,340 B2 11/2002 Kutschi
6,578,220 B1 * 6/2003 Smith ..... 5/740
6,602,579 B2 * 8/2003 Landvik ..... 428/158
6,866,915 B2 * 3/2005 Landvik ..... 428/158
7,191,483 B2 * 3/2007 Hochschild ..... 5/740
2004/0237206 A1 * 12/2004 Webster et al. ..... 5/727
2006/0048303 A1 3/2006 Reyes Cuadros

FOREIGN PATENT DOCUMENTS

GB 2161376 A * 1/1986

* cited by examiner

*Primary Examiner*—Michael Trettel
(74) *Attorney, Agent, or Firm*—Ted Masters

(57) ABSTRACT

A ventilated mattress includes a top foam layer having a plurality of spaced apart holes which extend through the thickness of the top foam layer. The top foam layer rests upon a bottom foam layer which has an upward facing side which has a convoluted surface containing upward projections which are spaced apart by valleys, thereby creating structural passageways for air to flow into and from the holes. When a force, such as the weight of a person, is applied to the top foam layer, air flows out the sides of the mattress through air passageways created by the upward projections and valleys of the convoluted surface. Conversely, when the force is removed air flow into the sides of the mattress through the air passageways.

7 Claims, 6 Drawing Sheets

20
28
F
A2
22
A3
38
A1
30

VENTILATED MATTRESS AND METHOD

TECHNICAL FIELD

The present invention pertains generally to mattresses, and more particularly to a ventilated foam mattress in which air flows both into and out of the mattress.

BACKGROUND OF THE INVENTION

Mattresses made from foam are well known in the art. These mattresses can be made of foams having different density (lb. values) and firmness (indentation load deflection, ILD values) to suit the needs of the particular user. However, a problem exists with a foam mattress because without ventilation, moisture, objectionable odors and heat can build up within the mattress. Some manufacture designs have attempted to solve this by placing convoluting on the surface of the foam directly underneath the user, but unfortunately, the comfort of the mattress suffers, as an uneven surface is not comfortable for many users. It is well known that visco-elastic memory foam does not breathe well, so some manufacture designs have proposed ventilation holes in the top layer of foam, but without any outlet for the airflow to vent to, air just becomes trapped and not exchanged unless the user moves away from the holes. Ventilating airflow at the bottom of the mattress is difficult, as the mattress foundation underneath will stifle airflow.

BRIEF SUMMARY OF THE INVENTION

The present invention is directed to a ventilated foam mattress in which air flows both into and out of the mattress during normal mattress use. This air flow purges moisture, heat and unpleasant odors from the mattress, and thereby keeps the mattress fresh and prolongs its life. It also offers an increased measure of extra comfort when lying or rolling over on the mattress as the airflow exchange occurs. The mattress has at least two layers with the top layer being ventilated with vertical holes that open up to the layer below and allow air flow to circulate both up and down vertically through the holes. The bottom layer is convoluted having upward projections and valleys which create air flow channels or passageways which allow airflow to circulate horizontally both in and out of the side of the mattress.

When a downward compressive forces are applied to the top layer of foam from a weighted object (such as a person), airflow will circulate both out of the sides of the mattress between the top and bottom layers, and out of the holes in the top of the top foam layer. Conversely, when the weighted object is removed, the decompression causes a reverse airflow into the sides of the mattress, and into the holes. This pumping action ventilates the mattress.

The use of visco-elastic memory foam on the top foam layer results in a slower, but more consistent and longer lasting pumping of air through the holes and across the air channels. Also a higher ILD polyurethane bottom foam layer(s) will give better integrity and resiliency to the air channels created on the surface of the bottom layer, while still allowing a more comfortable transition from the layer(s) above.

In accordance with a preferred embodiment of the invention, a ventilated mattress includes, a top foam layer having a first side and an opposite second side. The top foam layer has a plurality of spaced apart holes which extend through the top foam layer from the first side to the second side. The ventilated mattress also includes a bottom foam layer, which has an upward facing side which has a convoluted surface containing a plurality of upward projections spaced apart by valleys. In assembled form, the top foam layer resides on top of the bottom foam layer.

In accordance with an aspect of the invention, the upward projections include rounded peaks and the valleys include rounded valleys.

In accordance with another aspect of the invention, the top foam layer is fabricated from memory foam.

In accordance with another aspect of the invention, the bottom foam layer fabricated from polyurethane foam.

In accordance with another aspect of the invention, the top foam layer has an ILD of between about 8 and about 40.

In accordance with another aspect of the invention, the bottom foam layer has an ILD of between about 28 and about 70.

In accordance with another aspect of the invention, air flow passageways are created by the upward projections and the valleys, and the bottom foam layer has a high enough ILD so that when a specified downward force is applied to the top foam layer, the bottom foam layer will not compress enough to block the air flow passageways.

In accordance with another aspect of the invention, the top foam layer has a first ILD, the bottom foam layer has a second ILD, the second ILD being higher than the first ILD.

In accordance with another aspect of the invention, the holes have a diameter of between about one-eighth inch and about one inch.

In accordance with another aspect of the invention, the holes are spaced between about one half inch and about two inches.

In accordance with another aspect of the invention, the vertical distance from the top of an upward protuberance to the bottom of an adjacent valley is between about one half inch and about two inches.

In accordance with another aspect of the invention, the valleys are spaced apart between about one half inch and about two inches.

In accordance with another aspect of the invention, the top foam layer has a thickness of between about two inches and about seven inches.

In accordance with another aspect of the invention, the bottom foam layer has a thickness of between about three inches and about eight inches.

In accordance with another aspect of the invention, air flow passageways are created by the upward projections and the valleys. When a downward force is applied to the top foam layer, air flows through at least some of the air flow passageways and out of the side of the ventilated mattress.

In accordance with another aspect of the invention, when a downward force is applied to the top foam layer, and air also flows upward through some of the holes and downward through others of the holes.

In accordance with another aspect of the invention, when the downward force is removed, air flows into the sides of the mattress through at least some of the air flow passageways, and air also flows downward through at least some of said holes.

In accordance with another aspect of the invention, the holes of the top foam layer are horizontally arranged so that they reside substantially above the valleys of the convoluted surface of the bottom foam layer.

Other aspects of the present invention will become apparent from the following detailed description, taken in conjunction with the accompanying drawings, which illustrate, by way of example, the principles of the invention.

DETAILED DESCRIPTION OF THE INVENTION

Figure 1:
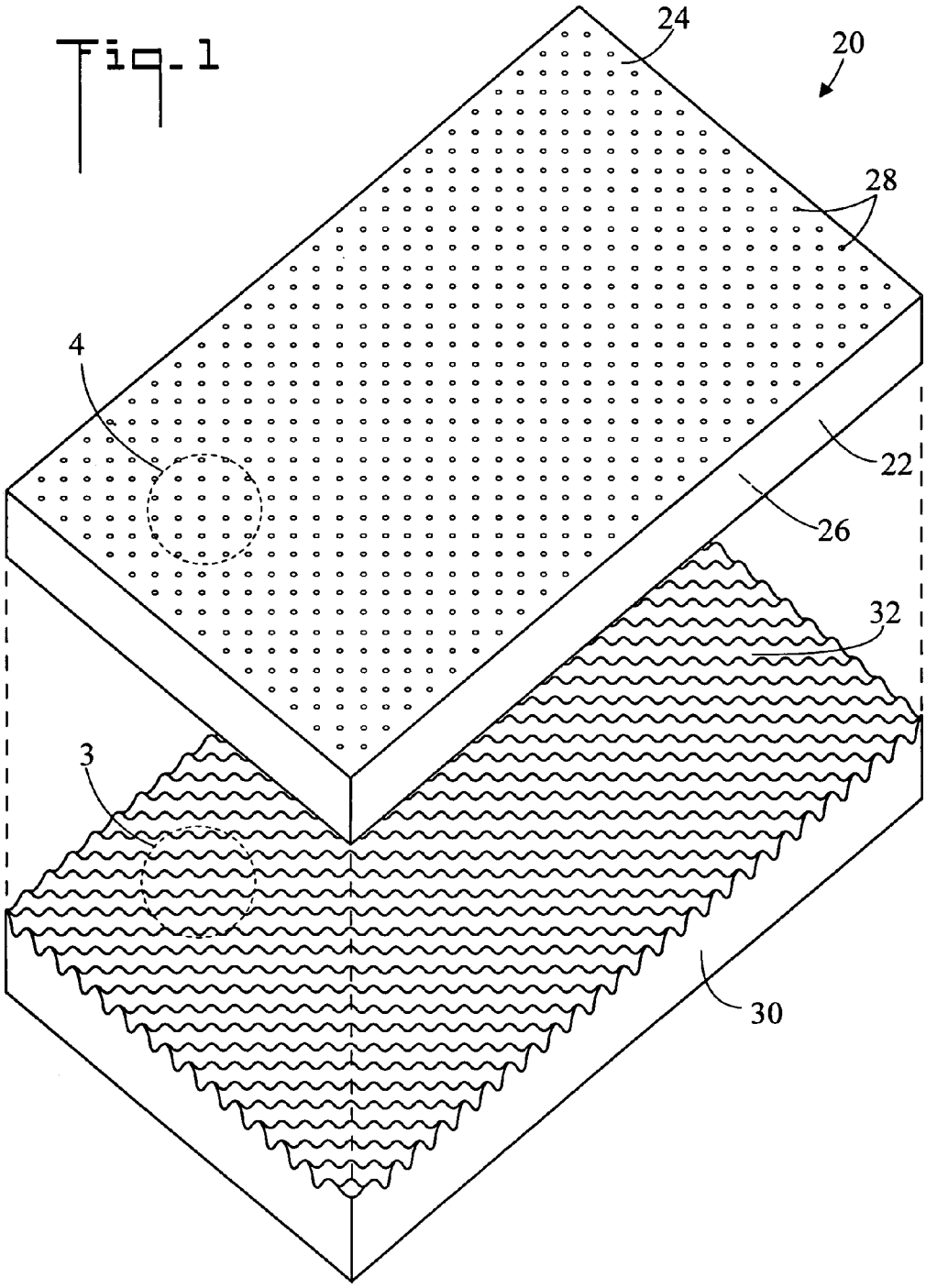
FIG. 1 is an exploded perspective view of a ventilated mattress in accordance with the present invention.

Referring initially to FIG. 1, there is illustrated an exploded perspective view of a ventilated mattress in accordance with the present invention, generally designated as 20. Ventilated mattress 20 includes a top foam layer 22 which has a first side 24 and an opposite second side 26. Top foam layer 22 also includes a plurality of spaced apart holes 28, the holes 28 extending all the way through top foam layer 22 from first side 24 to second side 26. In the shown embodiment, holes 28 are oriented vertically when ventilated mattress 20 is in its normal horizontal position. Ventilated mattress 20 also includes a bottom foam layer 30. Bottom foam layer 30 has an upward facing side 32 which has a convoluted surface which contains a plurality of upward projections 34 spaced apart by valley 36. That is, upward projections 34 and valleys 36 are disposed in an alternating pattern on upward facing side 32. In the shown embodiment, upward projections 34 include rounded peaks and valleys 36 include rounded valleys, which are generally sinusodial in shape (refer also to FIGS. 3 and 5). The upward projections 34 and valleys 36 are of the same size and are uniformly distributed over surface 32. It is noted that as used herein the term upward is referenced to the normal horizontal in use or ready for use orientation of ventilated mattress 20. It may be appreciated that upward projections 34 and valleys 36 are intended to embrace any convoluted shape which has alternating raised and lowered portions. For example, rather than being rounded peaks, upward projections 34 could have vertical projecting sides and flat tops, or upward sloping walls and flat or even pointed tops. Valleys 36 could be similarly shaped. Also, the spacing of upward projections 34 could vary from being close together to being far apart. In its ready for use configuration, top foam layer 22 resides on top of bottom foam layer 30 (refer also to FIG. 2).

In an embodiment of the invention, top foam layer 22 is fabricated from visco-elastic memory foam, and has an indentation load deflection (ILD) of between about 8 and about 40. This range of ILD both maintains user comfort and has enough firmness to keep holes 28 open during use. It is noted that while other types of foam, such as latex, or polyurethane could be used for top foam layer 22, memory foam provides a slow and steady air pumping action and therefore produces an excellent ventilating effect.

Figure 5:
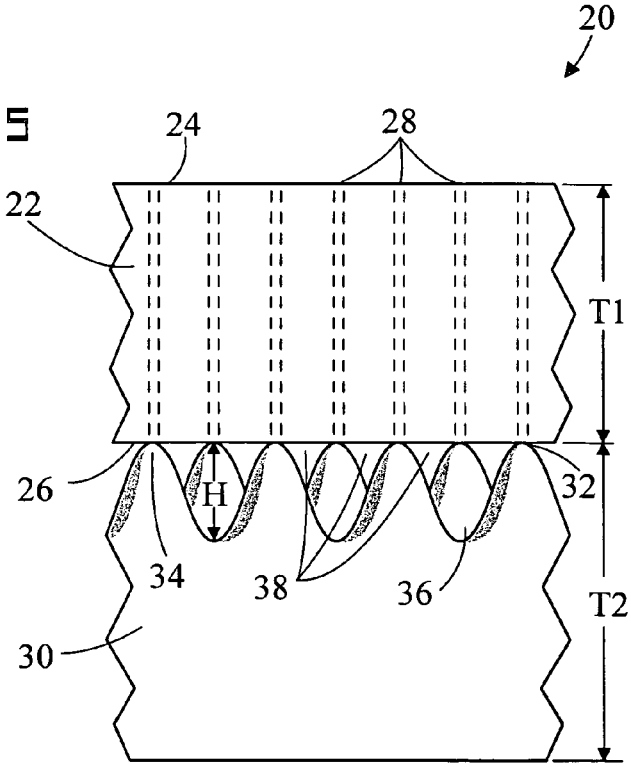
FIG. 5 is an enlarged fragmented side elevation view of the ventilated mattress in an uncompressed state.

The bottom foam layer 30 should have a high enough ILD so that when a specified downward force F is applied to top foam layer 22, bottom foam layer 30 will not compress enough to block air flow passageways 38 (refer also to FIG. 5 and the associated discussion). For most human beings, if bottom foam layer 30 has an ILD of between about 28 and about 70, this compression goal will be achieved. In an embodiment of the invention bottom foam layer 30 is fabricated from polyurethane foam. In an embodiment of the invention, top foam layer 22 has a first ILD, bottom foam layer 30 has a second ILD, the second ILD being higher than the first ILD.

Figure 2:
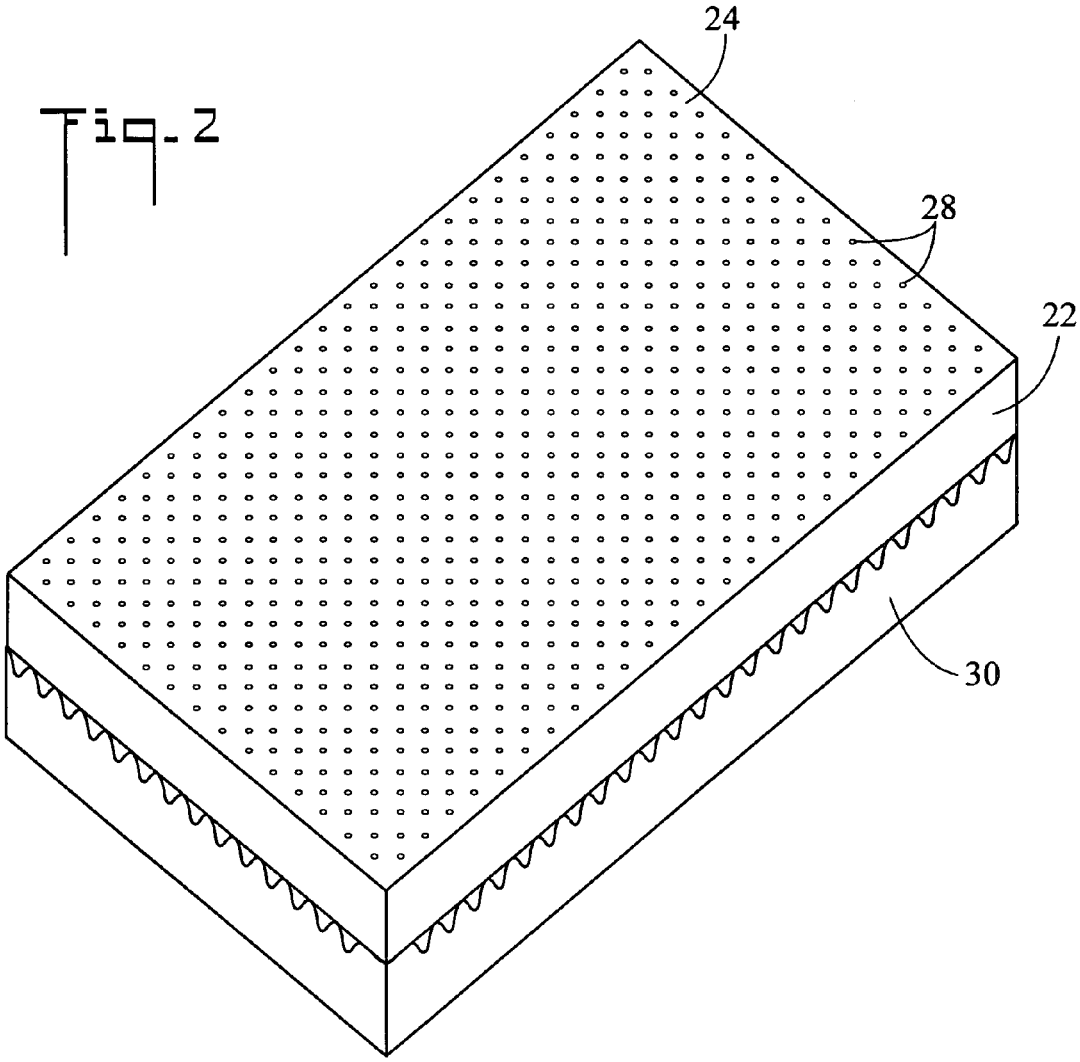
FIG. 2 is a perspective view of the ventilated mattress.

It is noted that top foam layer 22 and bottom foam layer 30 can be either of solid or layered construction. For example, bottom foam layer 30 could be made from two or more layers of the same or different foam material which are bonded together to form top foam layer 22. It is also noted that instead of bonding, a breathable material (such as netting) could be used to hold the multiple layers together. Similarly, top foam layer 22 could be bonded to bottom foam layer 30. Or alternatively, top foam layer 22 and bottom foam layer 30 could be held together by netting FIG. 2 is a perspective view of mattress 20 showing top foam layer 22 residing on top of bottom foam layer 30. It is also noted that ventilated mattress 20 may be covered with a breathable fabric.

Figure 3:
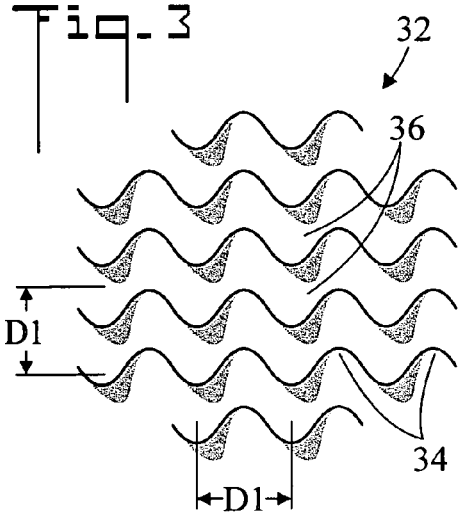
FIG. 3 is an enlarged view of area 3 of FIG. 1.

FIG. 3 is an enlarged view of area 3 of FIG. 1, showing upward projections 34 and valleys 36. In the shown embodiment of the invention, upward projections 34 and valleys 36 comprise a regular grid, and valleys 36 (and also upward projections 34) are spaced apart a distance D1 of between about one half inch and about two inches.

Figure 4:
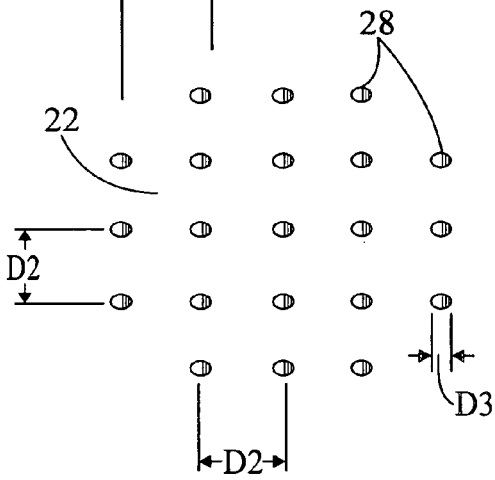
FIG. 4 is an enlarged view of area 4 of FIG. 1.

FIG. 4 is an enlarged view of area 4 of FIG. 1 showing the plurality of holes 28 in top foam layer 22. In the shown embodiment of the invention, holes 28 comprise a regular grid with holes 28 spaced apart a distance D2 of between about one half inch and about two inches. Also in an embodiment of the invention, holes have a diameter D3 of between about one-eighth inch and about one inch. This dimension range provides a balance between comfort and maintaining hole 28 integrity. It is noted that in the embodiments shown in FIGS. 3 and 4, the spacing of the upward projections 34 and valleys 36 is equal to the spacing of the holes 28 (ie, D1 equals D2). This spacing coupled with proper registration of top foam layer 22 with bottom foam layer 30 maximizes air flow through holes 28 (refer to FIG. 9 and the associated discussion).

FIG. 5 is an enlarged fragmented side elevation view of mattress 20 in an uncompressed state. Air flow passageways or channels 38 are created by upward projections 34 and valleys 36 of convoluted upward facing side 32 of bottom foam layer 30. It is through these air flow passageways 38 that air flows out of and into the sides of ventilated mattress 20. Bottom foam layer 30 has a high enough ILD so that when a specified downward force F (such as the weight of a person) is applied to top foam layer 22, bottom foam layer 30 (and particularly the upward projections 34 of bottom foam layer 30) will not compress enough to block air flow passageways 38 (refer also to FIG. 8 and the associated discussion).

In an embodiment of the invention, the vertical distance H from the top of an upward projection 34 to the bottom of an adjacent valley 36 is between about one half inch and about two inches. Also in embodiments of the invention, top foam layer 22 has a thickness T1 of between about two inches and about seven inches, and bottom foam layer 30 has a thickness T2 of between about three inches and about eight inches.

Figure 6:
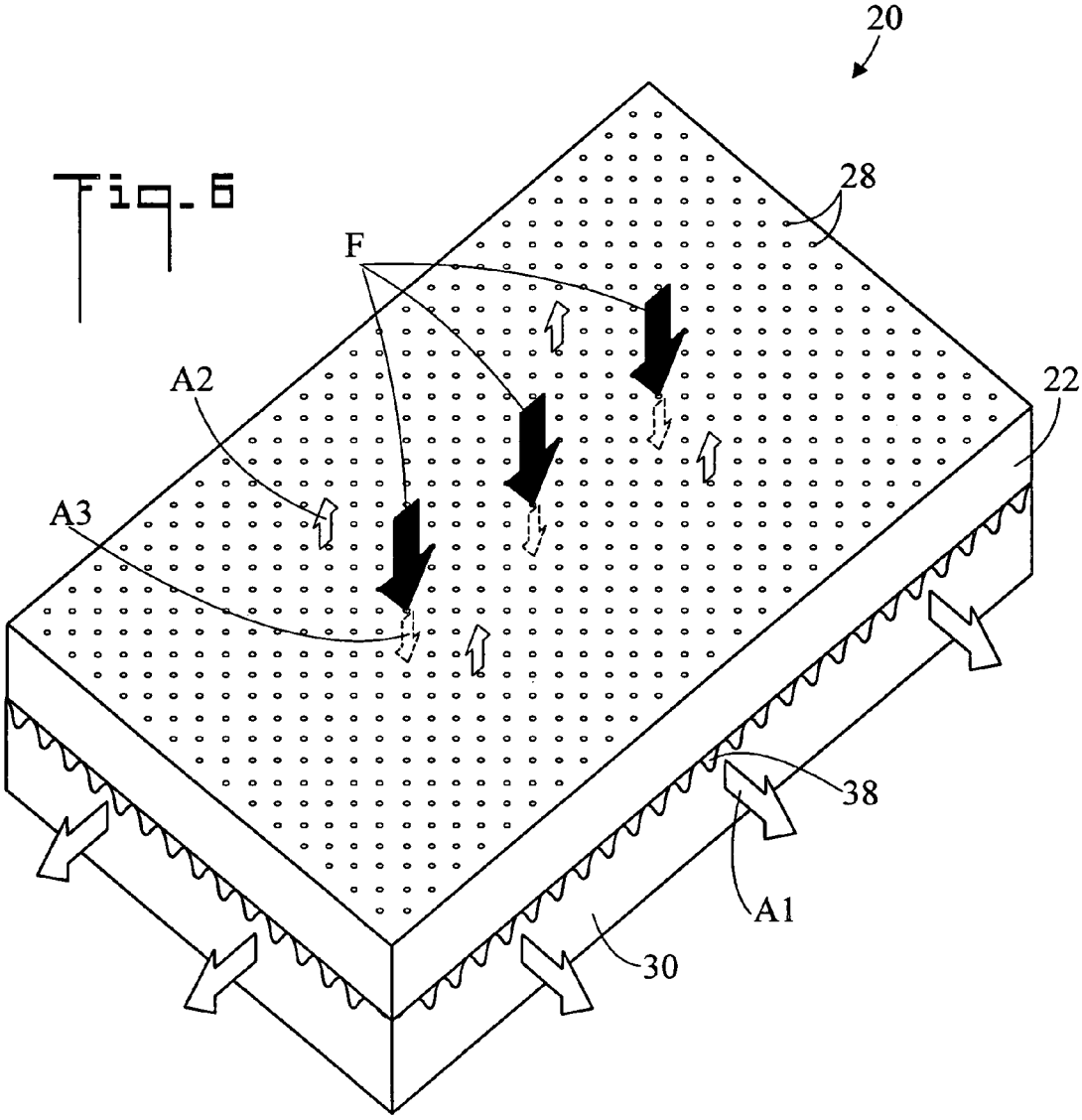
FIG. 6 is a perspective view showing air flowing out of the ventilated mattress.

FIG. 6 is a perspective view showing air flowing out of ventilated mattress 20. When a downward force F such as that of a person is applied to top foam layer 22, air Al flows through at least some of the air flow passageways 38 (refer to FIG. 5 and the associated discussion) and out of the sides of ventilated mattress 20. Also, when the downward forces is applied, air A2 will also flow upward through some of holes 28 and air A3 will flow downward through others of holes 38. The upward air flow A2 occurs at those hole 28 locations which are near the applied force F but not blocked thereby. The downward air flow A3 occurs at those hole 28 locations which are blocked by the downward force F (e.g. the body of a person).

It may further be appreciated that depending upon where downward force F is applied on top layer 22, air flow A1, A2, and A3 may be limited to the area immediately adjacent to downward force F. For example, if downward force F is applied to a corner of ventilated mattress 20, there may be little or no air flow around the opposite corner.

Figure 7:
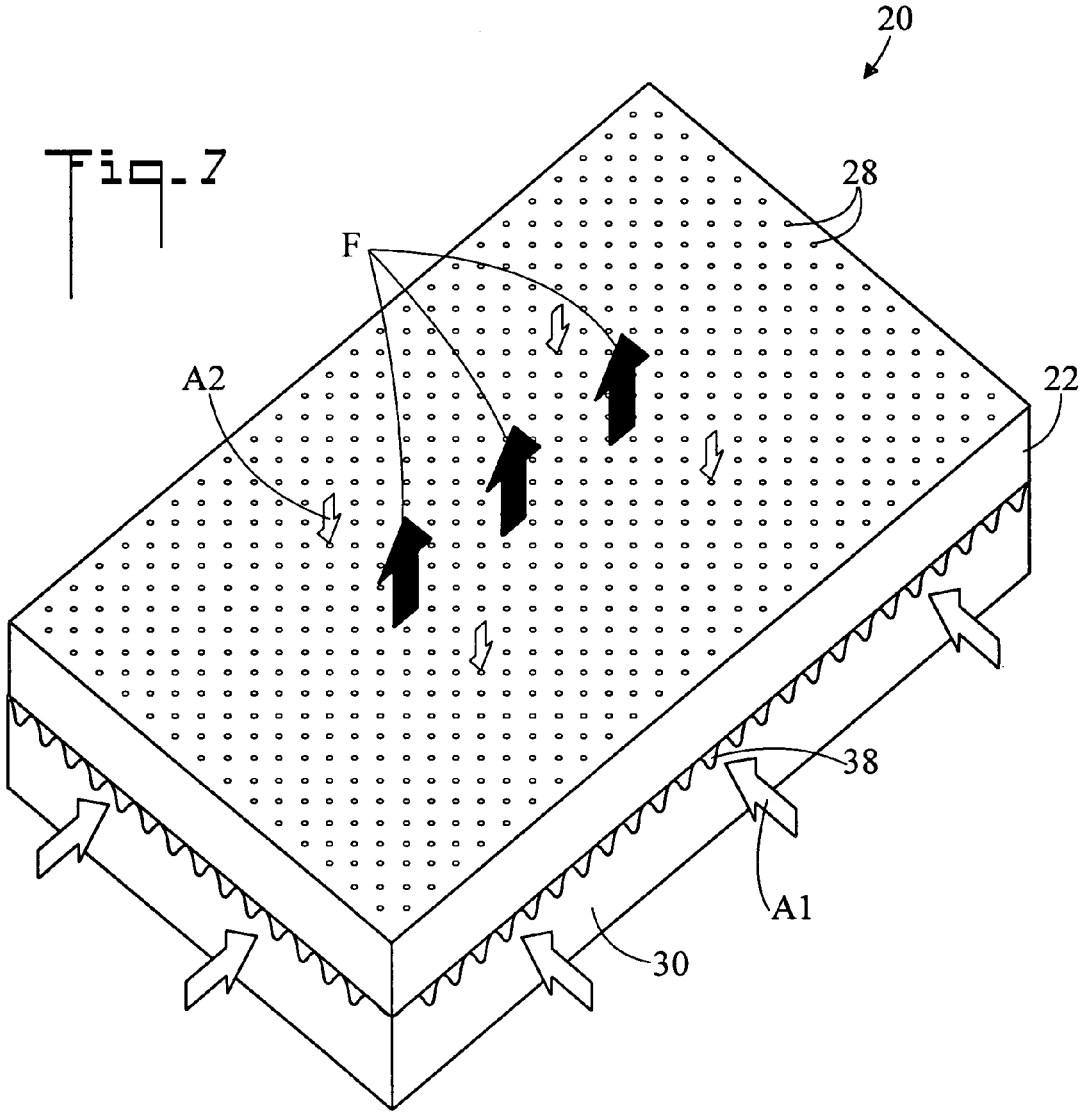
FIG. 7 is a perspective view showing air flowing into the ventilated mattress.

FIG. 7 is a perspective view showing air flowing into ventilated mattress 20. When a downward force F is removed from top foam layer 22, air flows into the sides of ventilated mattress 20 through at least some of air flow passageways. Also, when the downward force is removed, air A2 will also flow downward into ventilated mattress 20 through at least some of holes 28.

The generally outward air flow of FIG. 6 and the inward air flow of FIG. 7 result in a "breathing" action which ventilates ventilated mattress 20. It is noted that when a person turns over or otherwise moves in his or her sleep, the ventilation action of the present invention occurs. Air can also circulate through air flow passageways 38 and through holes 28 even when no compressive or decompressive force is applied to ventilated mattress 20 (i.e. when the mattress is not being used).

Figure 8:
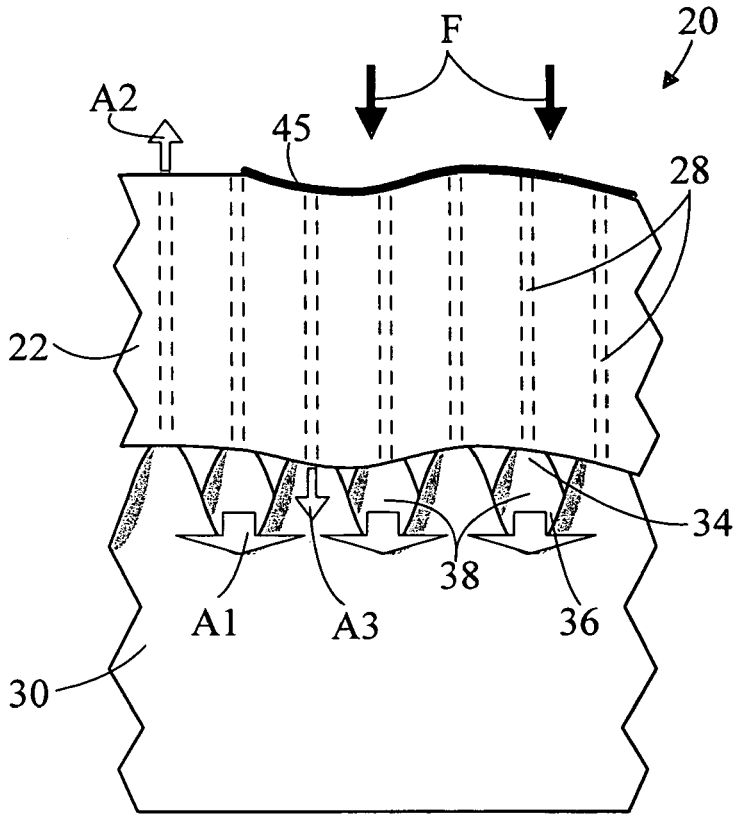
FIG. 8 is an enlarged fragmented side elevation view of a downward force being applied to the ventilated mattress; and, FIG. 9 is a fragmented top plan view of FIG. 8.

FIG. 8 is an enlarged fragmented side elevation view of a downward force being applied to ventilated mattress 20 and air A3 flowing out of the side of the mattress (refer also to FIG. 6). Air flow A2 and A3 are also shown. It is noted that bottom foam layer 30 has been compressed slightly by top foam layer 22, however not so much as to close air flow passageways 38. It is also noted that top foam layer 22 conforms to the upward projections 34 of bottom foam layer 30, but again not so much as to close air flow passageways 38. Of course air flow out of the side of ventilated mattress 20 will be reversed when the downward force is removed (refer to FIG. 7). Wide line 45 indicates the area of top foam layer 22 which is being compressed by force F.

Figure 9:
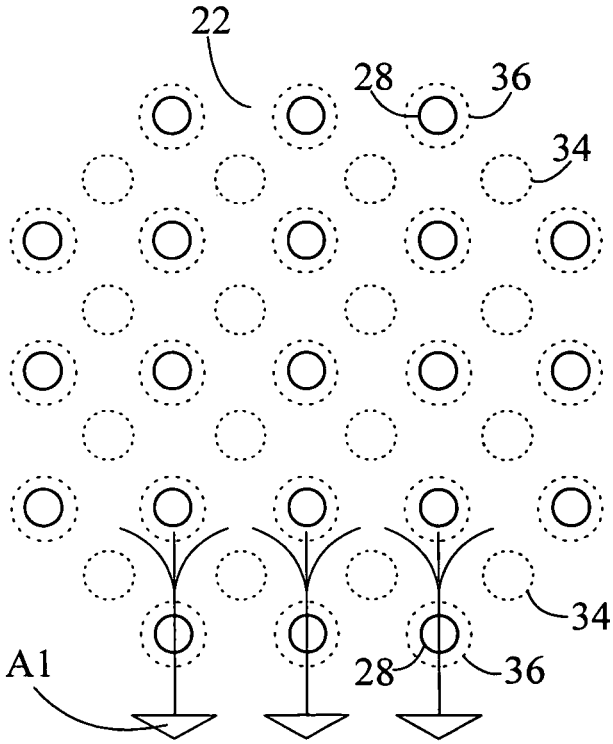

FIG. 9 is a fragmented top plan view of FIG. 8. Holes 28 of top foam layer 22 are horizontally arranged so that they are substantially above 36 valleys of convoluted surface 32. By registering holes 28 and valleys 36 in this manner, it is assured that upward projections 34 will not block air flow through holes 28.

In terms of use, a method for ventilating a foam mattress, comprises:

(a) providing a ventilated mattress 20 including:

a top foam layer 22 having a first side 24 and an opposite second side 26;

top foam layer 22 having a plurality of spaced apart holes 28, the holes 28 extending through top foam layer 22 from first side 24 to second side 26;

a bottom foam layer 30;

bottom foam layer 30 having an upward facing side 32, the upward facing side 32 having a convoluted surface which contains a plurality of upward projections 34 spaced apart by valleys 36, the upward projections 34 and valleys 36 creating air flow passageways 38; and, top foam layer 22 residing on top of bottom foam layer 30.

(b) applying a downward force upon top foam layer 22, causing air to flow through at least some of the air flow passageways 38 and out of ventilated mattress 20; and, (c) removing the downward force. of step (b), causing air to flow into ventilated mattress 20 and through at least some of the air flow passageways 38.

The preferred embodiments of the invention described herein are exemplary and numerous modifications, variations, and rearrangements can be readily envisioned to achieve an equivalent result, all of which are intended to be embraced within the scope of the appended claims.

I claim:

1. A ventilated mattress, comprising:

a top foam layer having a first side and an opposite second side;

said top foam layer having a plurality of spaced apart holes, said holes extending through said top foam layer from said first side to said second side;

a bottom foam layer;

said bottom foam layer having an upward facing side, said upward facing side having a convoluted surface containing a plurality of upward projections spaced apart by valleys;

said top foam layer residing on top of said bottom foam layer;

said holes of said top foam layer horizontally arranged so that they are substantially above said valleys of said convoluted surface:

air flow passageways created by said upward projections and said valleys; and, said bottom foam layer having a high enough ILD so that when a specified downward force is applied to said top foam layer, said bottom foam layer will not compress enough to block said air flow passageways.

2. The ventilated mattress according to claim 1, further including:

air being able to flow through all of said air flow passageways when a downward force is continuously applied to said top foam layer.

3. A ventilated mattress, comprising:

a top foam layer having a first side and an opposite second side;

said top foam layer having a plurality of spaced apart holes, said holes extending through said top foam layer from said first side to said second side;

a bottom foam layer;

said bottom foam layer having an upward facing side, said upward facing side having a convoluted surface containing a plurality of upward projections spaced apart by valleys;

said top foam layer residing on top of said bottom foam layer; and, said holes of said top foam layer horizontally arranged so that they are substantially above said valleys of said convoluted surface, and so that said upward projections will not block air flow through said holes.

4. The ventilated mattress according to claim 3, further including:

said upward projections including rounded peaks and said valleys including rounded valleys;

said top foam layer fabricated from memory foam;

said bottom foam layer fabricated from polyurethane foam;

said holes having a diameter of between about one-eighth inch and about one inch;

said top foam layer having an ILD of between about 8 and about 40;

said bottom foam layer having an ILD of between about 28 and about 70;

air flow passageways created by said upward projections and said valleys;

said bottom foam layer having a high enough ILD so that when a specified downward force is applied to said top foam layer, said bottom foam layer will not compress enough to block said air flow passageways;

said top foam layer having a first ILD, said bottom foam layer having a second ILD, said second ILD higher than said first ILD;

said ventilated mattress having four side walls;

air flow passageways created by said upward projections and said valleys;

when a downward force is applied to said top foam layer, air flows through at least some of said air flow passageways and out of said ventilated mattress through said side walls; and, when said downward force is removed from said top layer, air flows into said ventilated mattress through said side walls.

5. A method for ventilating a foam mattress, comprising:

(a) providing a ventilated mattress including:

a top foam layer having a first side and an opposite second side;

said top foam layer having a plurality of spaced apart holes, said holes extending through said top foam layer from said first side to said second side;

a bottom foam layer;

said bottom foam layer having an upward facing side, said upward facing side having a convoluted surface containing a plurality of upward projections spaced apart by valleys, said upward projections and said valleys creating air flow passageways;

said top foam layer residing on top of said bottom foam layer;

said holes of said top foam layer horizontally arranged so that they are substantially above said valleys of said convoluted surface; and, said bottom foam layer having a high enough ILD so that when a specified downward force is applied to said top foam layers said bottom foam layer will not compress enough to block said air flow passageways;

(b) applying a downward force upon said top foam layer, causing air to flow through at least some of said air flow passageways and out of said ventilated mattress;

(c) removing said downward force of step (b), causing air to flow into said ventilated mattress and through at least some of said air flow passageways; and, (d) Applying a downward force to said top foam layer causing air to flow upward through some of said holes and downward through other said holes.

6. A ventilated mattress, comprising:

a top foam layer having a first side and an opposite second side;

said top foam layer having a plurality of spaced apart holes, said holes extending through said top foam layer from said first side to said second side;

a bottom foam layer;

said bottom foam layer having an upward facing side, said upward facing side having a surface containing a plurality of upward projections spaced apart by valleys;

said upward projections having vertically projecting sides and flat tops;

said top foam layer residing on top of said bottom foam layer;

air flow passageways created by said upward projections and said valleys;

said bottom foam layer having a high enough ILD so that when a specified downward force is applied to said top foam layer, said bottom foam layer will not compress enough to block said air flow passageways; and air being able to flow through all of said air flow passageways when a downward force is continuously applied to said top foam layer.

7. A ventilated mattress, comprising:

a top foam layer having a first side and an opposite second side;

said top foam layer having a plurality of spaced apart holes, said holes extending through said top foam layer from said first side to said second side;

a bottom foam layer;

said bottom foam layer having an upward facing side, said upward facing side having a surface containing a plurality of upward projections spaced apart by valleys;

and, said top foam layer residing on top of said bottom foam layer; and, said holes of said top foam layer horizontally arranged so that they are substantially above said valleys of said convoluted surface;

air flow passageways created by said upward projections and said valleys;

said bottom foam layer having a high enough ILD so that when a specified downward force is applied to said top foam layer, said bottom foam layer will not compress enough to block said air flow passageways;

air being able to flow through all of said air flow passageways when a downward force is continuously applied to said top foam layer;

air can flow by entering in through the upper layer holes and flow through passageways and out the sides when a downward force is continuously applied to ventilated mattress; and, air can flow by entering in through the sides of the mattress and flow through passageways and out through holes when a downward force is continuously applied to ventilated mattress.

* * * * *